United States Patent [19]

Hopkins et al.

[11] 4,044,914

[45] Aug. 30, 1977

[54] REFUSE CONTAINER

[75] Inventors: Donald J. Hopkins, Knoxville; John C. Salyers, Oak Ridge; Paul L. Goranson, Knoxville, all of Tenn.

[73] Assignee: Carrier Corporation, Syracuse, N.Y.

[21] Appl. No.: 641,371

[22] Filed: Dec. 17, 1975

[51] Int. Cl.[2] ..... B65D 25/10

[52] U.S. Cl. ..... 220/93; 214/38 D; 214/41 A; 214/83.3; 214/152; 100/229 A

[58] Field of Search ..... 214/41 A, 38 D, 82, 214/83.3, 152; 220/93, 200, 1 T; 100/229 A

[56] References Cited

U.S. PATENT DOCUMENTS

| | | | |
|---|---|---|---|
| 3,059,789 | 10/1962 | Bowles | 214/41 |
| 3,257,012 | 6/1966 | Berolzheimer | 214/83.3 |
| 3,556,324 | 1/1971 | McCarthy | 214/152 |

*Primary Examiner*—George T. Hall
*Attorney, Agent, or Firm*—Burns, Doane, Swecker & Mathis

[57] ABSTRACT

A refuse container is disclosed for use in both storage and transportation of accumulated refuse. The container body is an elongated cylindrical member having a rectangular cross section. The container includes a horizontally hinged tailgate having a vertically slidable portion which opens to admit refuse into the container interior. The tailgate lower edge is provided with a latching means which cooperates with cooperating connector means carried by the container frame. An over-center latching mechanism maintains engagement between the latching means and the connector means and includes a latching yoke which prevents inadvertent unlatching of the tailgate. The second end of the container is generally open and has a transverse bulkhead which is slidable between the container ends. As the container is filled, the transverse bulkhead recedes from the tailgate end and provides a controlled resistance against material being compressed in the container. The sliding bulkhead cooperates with longitudinally extending guides in the container interior and has releasable friction pads which provide a controlled frictional resistance force. The friction pads are released during movement of the bulkhead towards the tailgate during container emptying.

7 Claims, 11 Drawing Figures

FIG.7
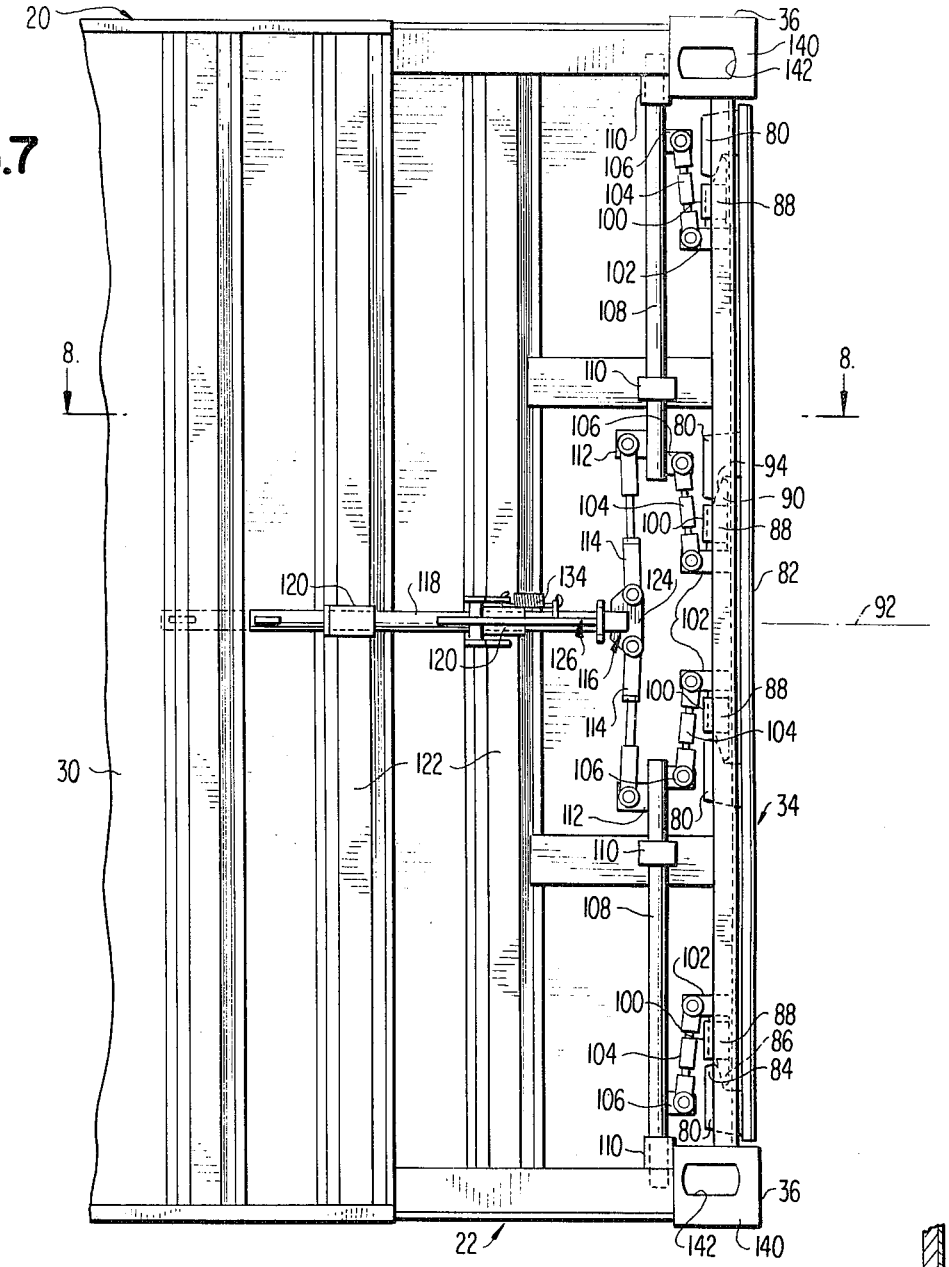
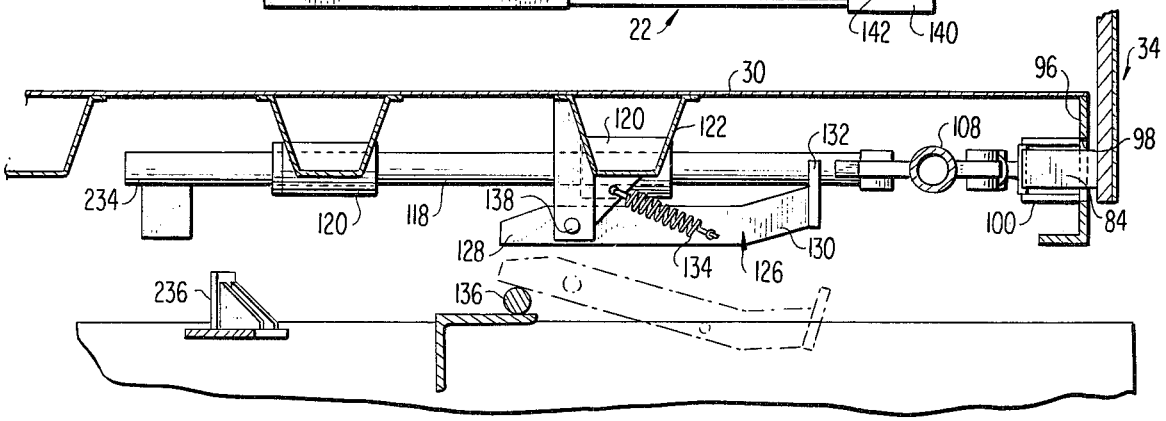
FIG.8

FIG.9
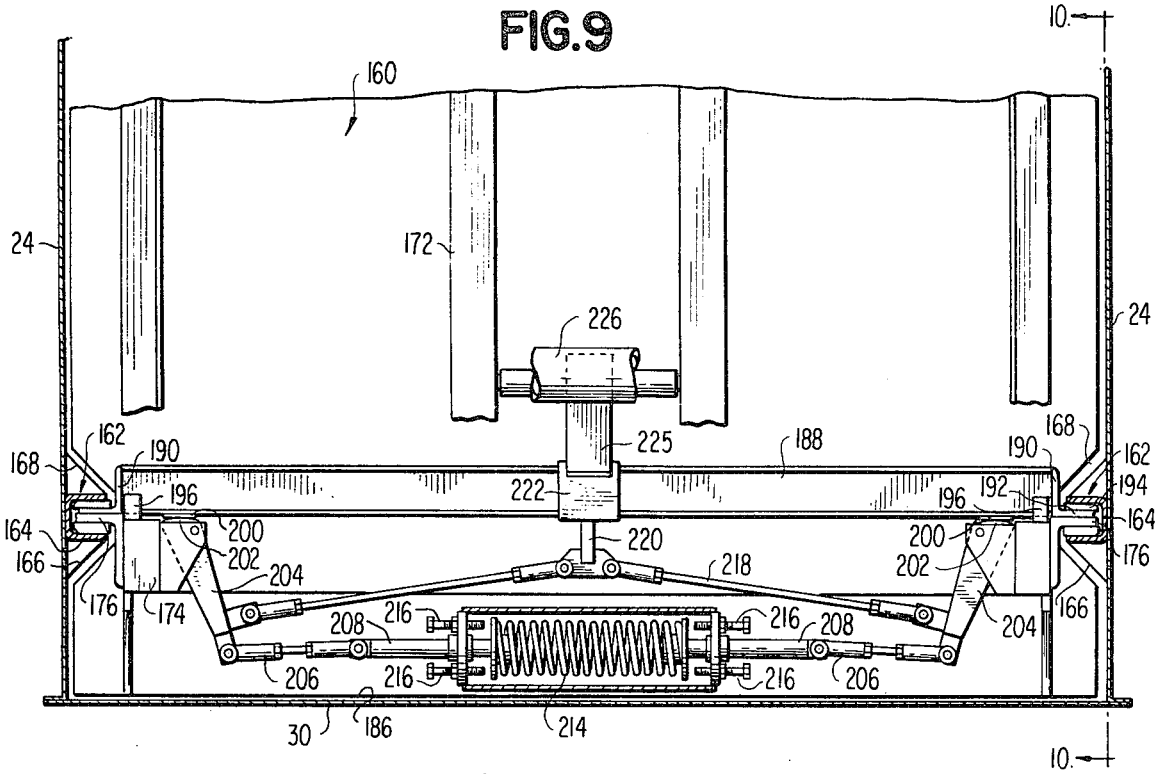
FIG.10
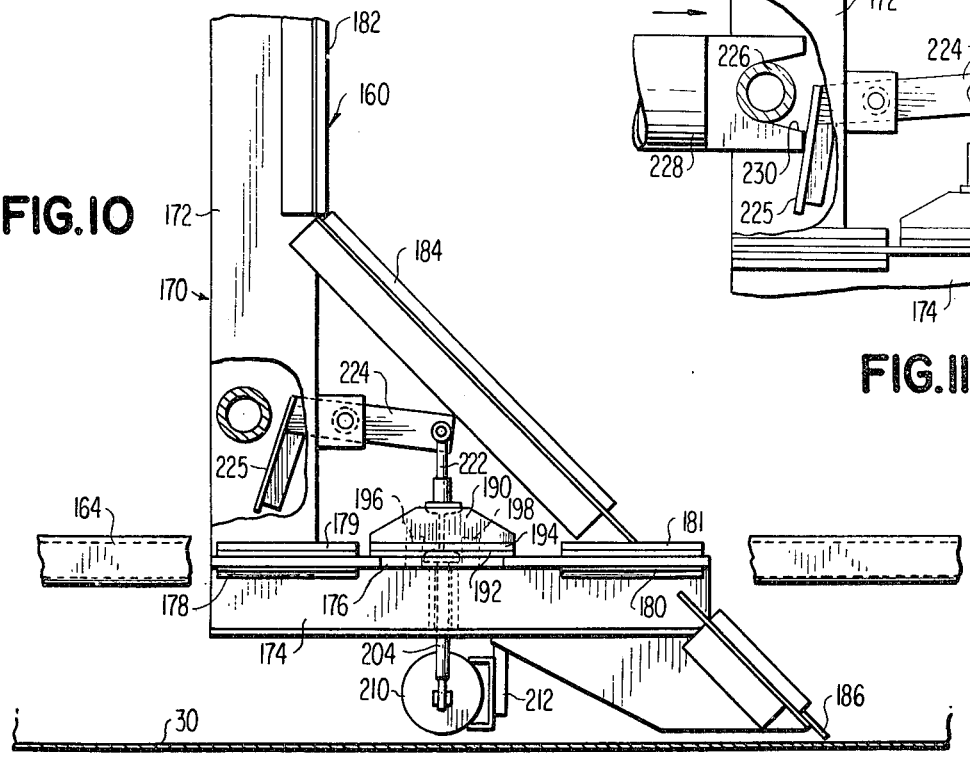
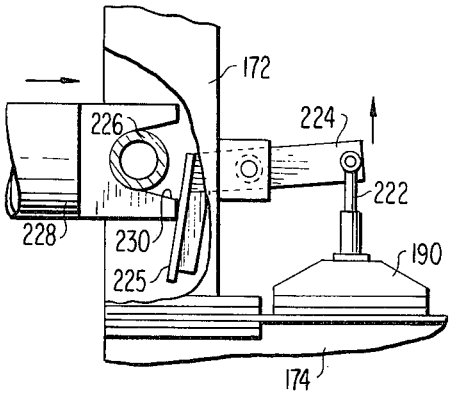
FIG.11

REFUSE CONTAINER

CROSS REFERENCES TO RELATED APPLICATIONS

This application is related to the following commonly assigned applications which are copending herewith:

"Method and Apparatus for Transferring Refuse," by Harvey W. Lieberman and John C. Salyers, Ser. No. 641,757, filed Dec. 17, 1975; "Method and Apparatus for Loading Refuse Into Containers" by Harvey W. Lieberman, Paul L. Goranson, R. Houston Ratledge, Jr. and John C. Salyers, Ser. No. 641,375, filed Dec. 17, 1975; "Method and Apparatus for Unloading Refuse Containers" by Harvey. W. Lieberman, Samuel E. Harvey, J. Stephen Whitehead, and Paul L. Goranson, Ser. No. 641,524, filed Dec. 17, 1975; and "Methods and Apparatus for Controlling an Hydraulic Cylinder," by Harvey W. Lieberman and J. Stephen Whitehead, Ser. No. 641,370, filed Dec. 17, 1975.

Each of the above-identified applications is expressly incorporated herein by this reference thereto.

BACKGROUND OF THE INVENTION

This invention relates generally to metallic receptacles. More specifically, this invention relates to refuse containers adapted to receive, store and transport solid waste refuse material.

Metallic containers adapted to facilitate the disposal of solid waste refuse materials have long been known in the art. Typically, however, such containers comprise a rigid structure defining an enclosed volume and having a gate or door through which solid material passes to the enclosed volume.

Often, a packing device is used in conjunction with a relatively large capacity container to compact refuse materials in the container and improve disposal efficiency. For one reason or another, refuse material may create an internal obstruction in a rigid wall container which resists the introduction of additional waste material. With rigid walls, visual determination of the existence of such a blockage is not possible. If the packer cannot overpower the obstruction it will prevent further filling of the container. Consequently, the container may be removed from the packer prematurely.

Containers are also known which have one closed end adapted to be opened for container discharge and one open end which is closed by a slidably disposed bulkhead. The bulkhead may be translated towards the closed end to effect discharge of the container contents. During filling, the movable bulkhead is positioned at the open end and the container defines an essentially constant internal volume. Refuse material typically enters the container through hatches disposed along a top container surface adjacent to the open end. See for example U.S. Pat. No. 3,720,328 issued to H. B. MacKenzie on Mar. 13, 1973.

There are several problems with respect to the known containers having a movable bulkhead. For example, a top loaded container can have substantial nonuniformity in the degree of compaction of refuse material therein. In addition, a hinged door at the closed end allows an uncontrolled rate of discharge of the material contents when the door is opened. Moreover, a hinged door can become inadvertently unlatched resulting in an undesired discharge of the container contents.

Furthermore, the known containers with movable bulkhead are not compatible with horizontally reciprocable stationary compactors. This incompatability is particularly disadvantageous in large capacity containers since capital expenditures can be substantially reduced where a single compactor can be used to fill a plurality of containers one at a time.

Another disadvantage of the known containers having a slidable bulkhead and open hatches along an adjacent top surface concerns the structure of the container. The bottom, lateral sides and occasional cross members on the top resist most of the internal forces caused by compressed refuse material thus necessitating a substantially heavier construction than is needed, for example, in a container having essentially tubular configuration.

Accordingly, it is such that a need continues to exist for a refuse container which is free from the disadvantages discussed above and which has a large volumetric capacity to advantageously employ the economy of large scale in storage and transportation of solid waste materials.

OBJECTS AND SUMMARY OF THE INVENTION

It is therefore a general object of the present invention to provide a novel refuse container free from the disadvantages of previously known containers.

A more particular object of the present invention is to provide a novel refuse container having a longitudinally slidable transverse bulkhead which moves in response to the pressure of refuse material during compaction but with sufficient resistance to maintain the refuse in a compressed condition.

It is another object of the present invention to provide a refuse container having a hingedly mounted tailgate with a latching mechanism that will not release inadvertently.

A further object of the present invention is to provide a refuse container having a longitudinally slidable transverse bulkhead that yieldably resists movement of the transverse bulkhead away from a closed end during loading, but which is freely movable during movement of the transverse bulkhead toward the closed end to facilitate container emptying.

The above objects, as well as many others, are accomplished by an elongated metallic container having a cylindrical side wall with a generally rectangular cross section, a hingedly mounted end closure member, an open end, and a longitudinally slidable bulkhead assembly.

To connect the end closure member to the container frame, the end closure member is provided with a plurality of connector members which extend therefrom and which are adapted for engagement by a corresponding plurality of cam members carried by a latching assembly of the container frame. The latching assembly preferably includes an actuating assembly which moves the cam members into engagement with the connector members and retains the engagement therebetween with an over-center mechanical lock. Inadvertent release of the latching assembly is curtailed by locating the actuator assembly beneath the container.

In order to close the open end of the container, a longitudinally slidable, transversely extending bulkhead assembly is provided within the container. The bulkhead assembly is guided longitudinally and includes a releasable friction means that engages the container guides during movement of the bulkhead away from the closure member when the container is being filled with solid waste materials by a compactor. Preferably the friction means is releasable during translation of the transverse bulkhead toward the closure member to substantially reduce the force necessary to expel container contents through the opened end closure member.

The friction means may be provided with adjustments to vary the predetermined internal pressure that causes the bulkhead assembly to recede toward the open end. In this manner, the density of refuse in the container may be roughly controlled.

Longitudinally extending guide members may also be provided in the container to guide the reciprocatory movement of the bulkhead assembly between the ends of the container. As a result, the bulkhead assembly can be supported above the container floor to limit frictional contact therewith and the concomitant resistance to movement during container discharge.

BRIEF DESCRIPTION OF THE DRAWINGS

A preferred embodiment of the invention is illustrated in the accompanying drawings wherein:

FIG. 7 is a partial bottom view of the container of FIG. 1;

FIG. 8 is a view in partial cross section taken along line 8—8 of FIG. 7;

FIG. 9 is a view in partial cross section taken along the line 9—9 of FIG. 1 illustrating the bulkhead resistance apparatus;

FIG. 10 is a view in partial cross section taken along the line 10—10 of FIG. 9; and FIG. 11 is a view similar to FIG. 10 illustrating release of the resistance apparatus.

DESCRIPTION OF THE PREFERRED EMBODIMENT

Figure 1:
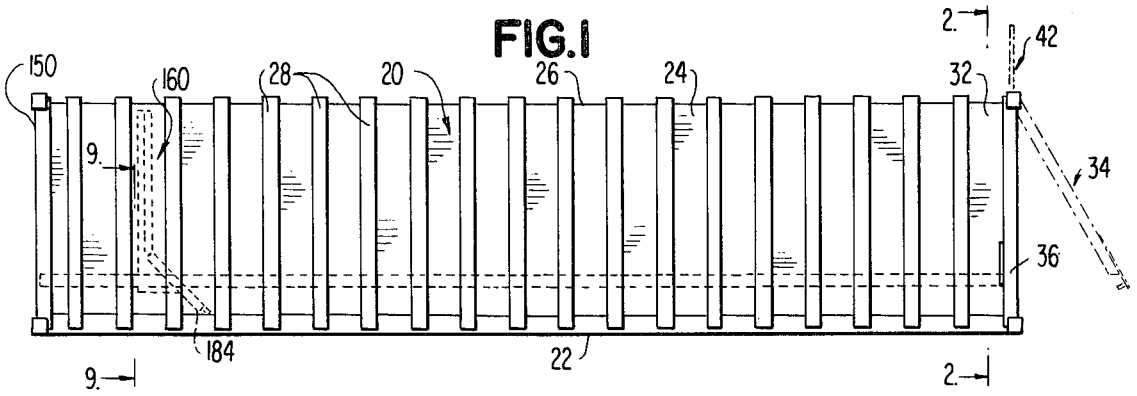
FIG. 1 is a side elevation of a refuse container with alternate positions of the tailgate assembly illustrated in phantom lines.

Disclosed in FIG. 1 is a container 20 according to the present invention which is adapted to receive, store and transport essentially solid waste material from a collecting location to a discharging location. One particularly desirable use for containers of the present invention is the storage and transportation of solid waste materials by rail or truck from satellite collection points to a centralized power generating facility which uses solid refuse material as a fuel.

A rectangular configuration of the container is desirable since it facilitates vertical storage of containers one on the other. While other cross sectional configurations may be selected without departing from the scope of the invention, the rectangular configuration provides good longitudinal and lateral stability against tipping.

Figure 2:
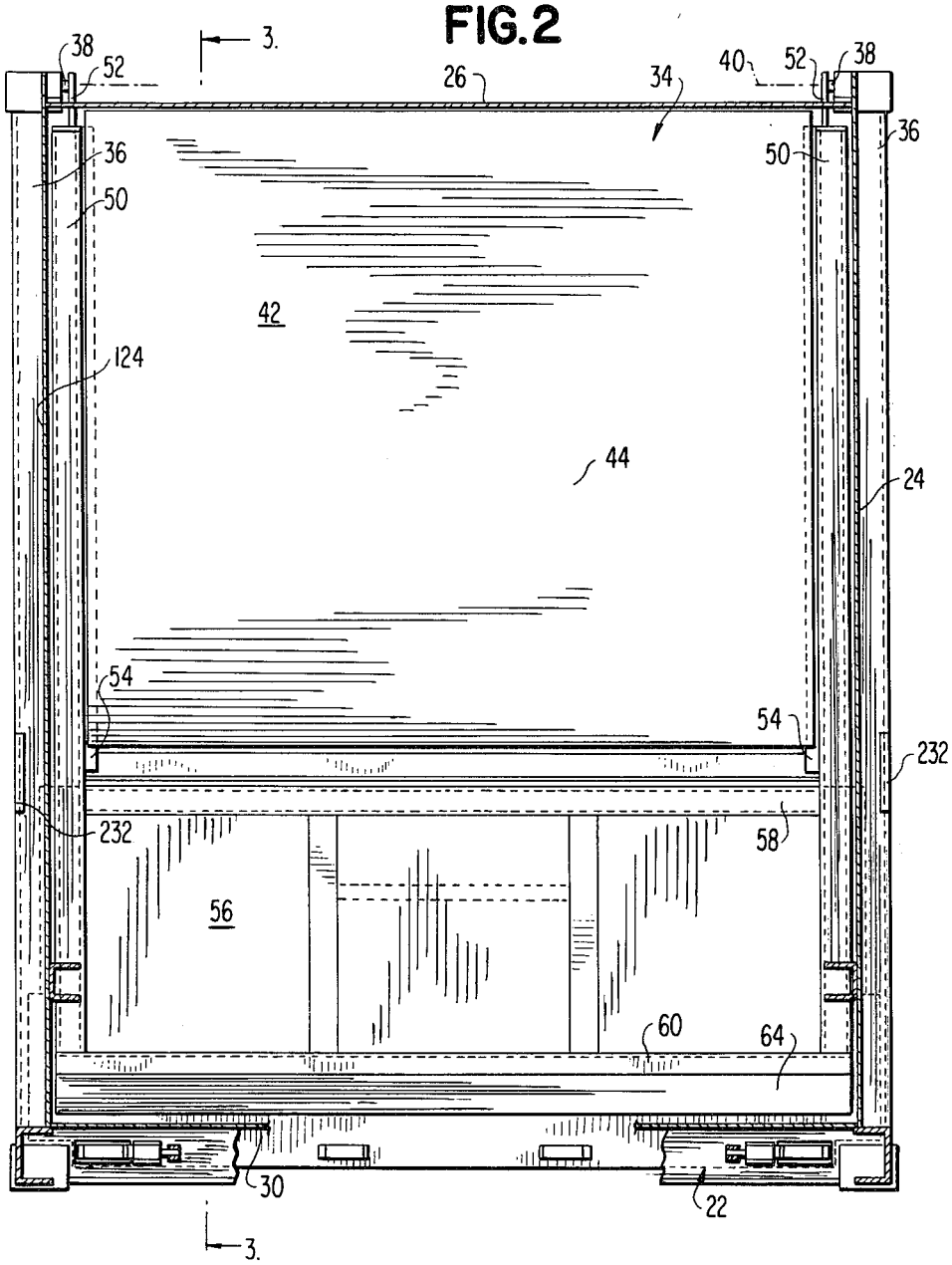
FIG. 2 is a view in partial cross section taken along the line 2—2 of FIG. 1.

Each container 20 includes a substantially horizontal bottom frame assembly 22 having a pair of vertically upstanding generally rectangular side walls 24 and a generally horizontal top wall 26. The bottom frame assembly 22 and side walls 24 and the top 26 define a tubular structure which is cylindrical with a generally rectangular cross section (see FIG. 2).

The side walls 24 and the top 26 may be provided with suitable reinforcing members such as the generally U-shaped steel channels 28 illustrated in FIG. 1. The walls 24, the top 26 and the bottom wall or floor 30 (see FIG. 2) may comprise sheets of suitable material such as steel which are connected at adjacent edges to provide an essentially fluid tight tubular shell.

One end 32 (see FIG. 1) of the container 20 is provided with an openable end closure or tailgate assembly 34. The tailgate 34 (see FIG. 2) is preferably hingedly connected to end columns 36 of the side walls 24 by suitable pivot pins 38 for movement about a horizontal axis 40 spaced slightly above the top surface 26 of the container 20. The upper portion of the tailgate 34 is provided with a vertically slidable closure door 42 which may comprise approximately two-thirds of the tailgate assembly 34. The lower one-third of the tailgate assembly 34 or the edge portion thereof is not adapted for movement with respect to the tailgate assembly 34 itself.

Figure 4:
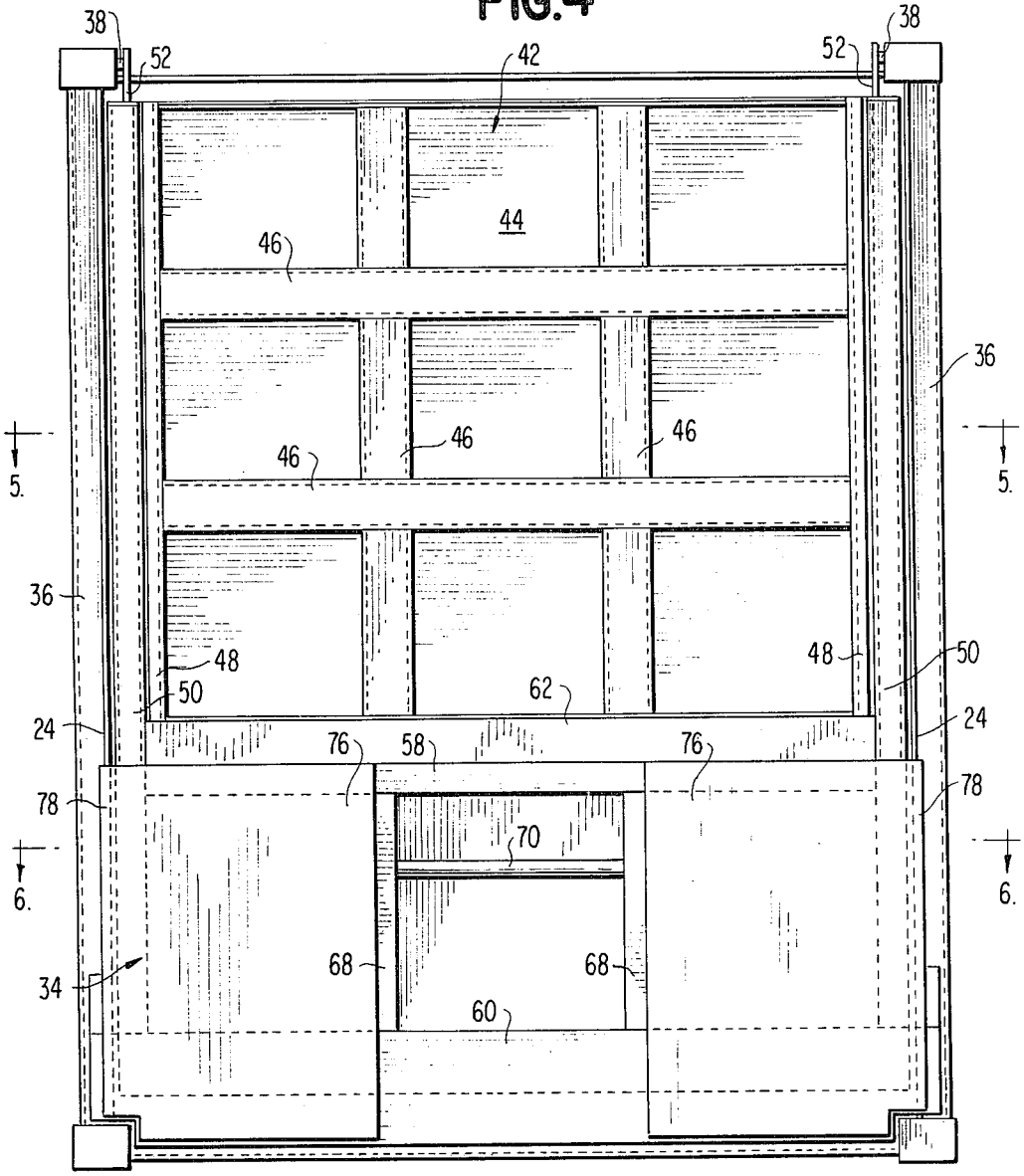
FIG. 4 is an end elevational view of the tailgate end of the container of FIG. 1.

The closure door 42 includes a substantially rectangular panel 44 which faces the interior of the container to provide a relatively smooth surface. The exterior side of the closure door 42 includes vertical and horizontal reinforcing channel members 46 (see FIG. 4) of a suitable material such as steel which serves to stiffen the closure door 42 against internal pressure.

Figure 5:
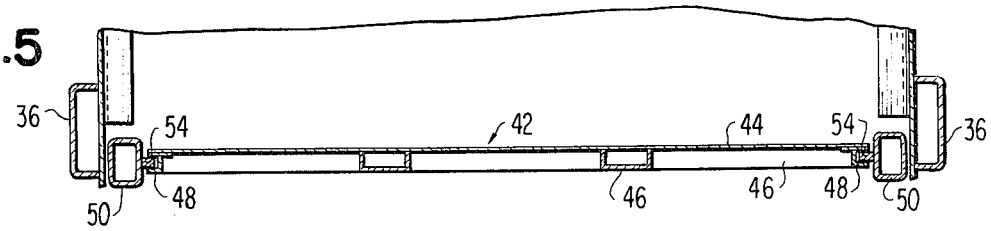
FIG. 5 is a view in partial cross section taken along the line 5—5 of FIG. 4.

Along each vertical edge of the panel 44 is a U-shaped channel member 48 (see FIG. 5) that is suitably secured to the panel 44. The tailgate assembly 34 (see FIG. 4) includes a vertically upstanding column 50 on each side which has a tongue 52 projecting from the upper end thereof. Each tongue 52 is mounted on a corresponding pivot pin 38. Each column 50 also includes a guide bar 54 (see FIG. 5) fastened thereto and projecting toward a corresponding channel member 48 of the closure door 42. The channel members 48 and the guide bars 54 guide the movement of the closure door 42 with respect to the tailgate assembly 34. The closure door 42 is raised to the position depicted by phantom lines in FIG. 1 when the container 20 is being filled. It will be apparent to those skilled in the art that the location of the channel members 48 and the cooperating guide bars 54 may be reversed, if desired.

Figure 3:
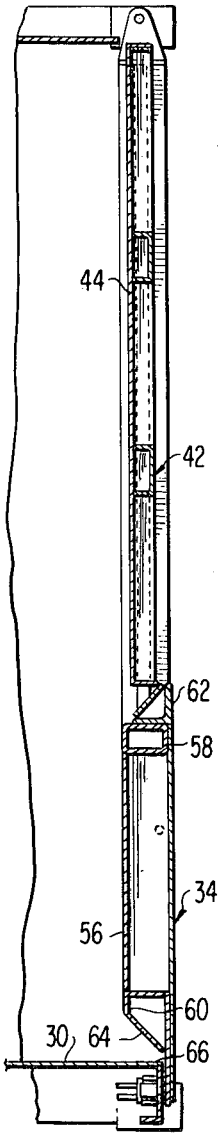
FIG. 3 is a view in partial cross section taken along the line 3—3 of FIG. 2.

The lower portion of the tailgate assembly 34 (see FIG. 2) has a relatively smooth internal surface 56 defined between the columns 50, an upper cross member 58 and a lower cross member 60. The upper cross member 58 has a triangularly shaped channel 62 (see FIG. 3) mounted thereon such that an inclined surface supports the lower edge of the closure door 42.

The lower cross member 60 has an inclined surface 64 which slopes upwardly and inwardly toward the container interior. The surface 64 is spaced from the container floor 30 so that a bulkhead assembly can advance to the edge 66 during discharge of the container contents without interfering with subsequent closing of the tailgate assembly 34.

Figure 6:
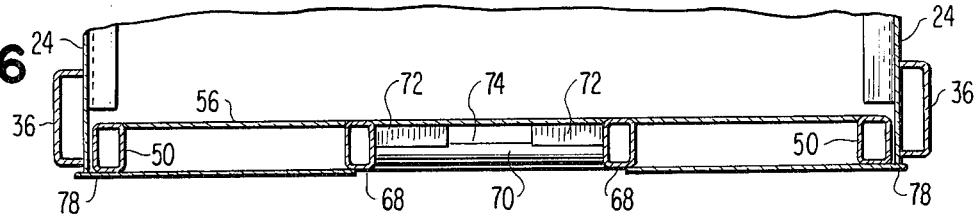
FIG. 6 is a view in partial cross section taken along the line 6—6 of FIG. 4.

On the exterior (see FIG. 4) of the tailgate assembly 34, the lower portion is provided with a pair of spaced apart vertical members 68 which extend between the upper cross member 58 and lower cross member 60. Intermediate the ends of the vertical members 68 is a generally circular bail 70 which is positioned adjacent to the external face of the tailgate assembly 34 (see FIG. 6). The bail is also strengthened by a pair of generally horizontal plates 72 which, along with the bail 70 and the surface 56, define a space 74. The space 74 is adapted to receive a hook to lift the tailgate assembly 34 during discharge of the container contents.

The exterior of the tailgate assembly 34 (FIG. 4) is provided with a pair of laterally spaced plates 76 which are suitably connected to the structural members and which extend laterally beyond the corresponding columns 50. The extended edge portions 78 along with extended portions of the lower cross member 60 overlie the end of the side walls 24 to limit movement of the tailgate assembly 34 into the container as well as to provide a seal to inhibit liquid refuse from draining out of the container. The lower edge portion of the tailgate assembly 34 (see FIG. 7) is provided with a tailgate connecting assembly which comprises a plurality of spaced-apart hooks or latch members 80. The latch members 80 are spaced symmetrically about the center line 82 of the tailgate assembly 34; each latch member 80 includes a laterally projecting portion 84 which is directed toward the centerline 82. Each latch member 80 is essentially L-shaped and is provided with a cam surface 86 on the laterally extending portion 84.

The tailgate connecting assembly is adapted to cooperate with a second connecting assembly carried by the substantially planar bottom frame 22 of the container 20. The second connecting assembly includes a plurality of lugs or connector members 88 each of which includes a laterally extending projection 90. The laterally extending projections 90 of the connector members 88 are directed away from the centerline 92 of the frame assembly 22 and have a complementary cam surface 94 that engages the cam surface 86 of the corresponding projection 84 of the first connector assembly to the tailgate tightly against the container side walls and the container frame.

Preferably four of the first connector members 80 and four of the second connector members 88 are provided to make an effective although not unduly expensive latching assembly.

The frame assembly 22 includes a downwardly extending skirt or apron 96 (see FIG. 8) at the end of the container and underlying an edge of the floor 30. The skirt 96 is essentially flush with the container floor 30 and is free of external projections. In this manner, refuse material is unimpeded during container dumping and does not hang up. The skirt 96 is provided with a plurality of rectangular openings 98 each of which is positioned and sized to receive a corresponding latching member 84.

Positioned below the floor 30 and on the internal surface of the skirt 96 are a plurality of sleeves 100 which may comprise three plates welded together in a U-shaped configuration and welded to the skirt 96. The sleeves 100 define guides for each of the second connector members 88.

Each of the second connector members 88 is provided with a longitudinally extending ear 102 to which an adjustable tie bar 104 is pivotally connected. The second end of each adjustable tie bar 104 is pivotally connected to a corresponding lateral projection 106 extending in the longitudinal direction from a transversely slidable link rod 108.

Two transversely slidable link rods 108 are provided which are coaxially positioned with respect to one another transversely of the container 20. The link rods 108 are also axially spaced apart symmetrically about the longitudinal center line 92 of the container 20. Each link rod 108 is slidably mounted in a corresponding pair of collars 110 mounted on the frame assembly 22 such that movement of the link rods 108 toward the center line 92 of the container 20 unlatches the second connector members 88 from the first connector members 80. Movement of the link rods 108 away from the center line 92 corresponds to a latching movement of the second connector members 88 with respect to the first connector members 80.

Each of the link rods 108 along with its associated adjustable tie bars 104 provides a linkage assembly for operating the corresponding second connector members 88. Each link rod 108 is provided with a laterally extending projection 112 extending away from the tailgate assembly 34 to avoid interference with the movement of the tie bars 104 and the second connector elements 88. The lateral projection 112 may be pivotally connected to a corresponding suitably adjustable tie rod 114 which comprises a member of an over-center mechanism.

The second end of each adjustable tie rod 114 may be pivotally connected to an end portion 116 of a longitudinally slidable actuator assembly which is disposed along the center line 92 of the frame assembly 22 and between the two spaced-apart linkage assemblies.

The actuating assembly includes an actuator rod 118 that is slidably mounted with respect to the container frame assembly 22 by a pair of collars 120 mounted on transverse reinforcing channels 122 under the floor 30. The end 116 of the actuator rod 118 may include a coupling member 124 to which each of the adjustable tie rods 114 of the over-center assembly are pivotally secured.

As the actuator rod 118 moves longitudinally toward the tailgate assembly 34, the tie rods 114 of the over-center assembly cause the link rods 108 of each corresponding linkage assembly to move away from the center line 92 of the frame assembly 22. In so doing, each tie bar 104 affixed to each of the linkage assemblies causes the corresponding second connector member 88 to move away from the center line 92 into engagement with the corresponding first latch member 80.

Engagement of the first and second latching members 80,88 occurs before the tie rods 114 of the over-center assembly attain a perpendicular relationship with respect to the longitudinal axis 92 and the actuator rod 118. The actuator rod 118 is then further advanced to a second position. As the actuator rod 118 advances to its second position, the tie rods 114 of the over-center mechanism pass through a perpendicular relationship with respect to the actuator rod 118. During disengagement, the second members 88 of the latching system must first advance toward the corresponding first member 80 as the tie rods 114 pass through the perpendicular relationship with the rod 118.

The length of the adjustable tie rods 114 in the over-center mechanism must be selected so that, as the actuator rod 118 moves from the second position to the first position, the lateral projection 90 of each second connector member 80 is withdrawn laterally toward the center line 92 of the frame assembly 22 by a distance that provides clearance between the lateral projection 90 of the second member 80 and the lateral projection 84 of the corresponding first member 80.

To inhibit the unintentional and accidental movement of the actuator rod 118 toward the first or unlatched position, the actuator rod 118 is positioned on the bottom of the container where it is relatively inaccessible.

To further prevent unlatching movement of the actuator rod 118, a suitable detent assembly may be provided. The detent assembly preferably includes a pivotally mounted yoke 126 (see FIG. 8) carried by the container frame assembly 22. The yoke 126 includes a lever end portion 128 and a yoke end 130 having a pair of upwardly projecting finger members 132.

The finger members 132 are spaced apart laterally to straddle the actuator rod 118 and are located adjacent to the coupling member 124 of the actuator rod 118 when the actuator rod 118 is in the second or latched position. Accordingly, any movement of the actuator rod 118 toward the first or unlatched position causes the coupling member 124 to abuttingly engage the finger members 132 straddling the actuator rod 118 and the finger members 132 thereby inhibit further longitudinal movement of the actuator rod 118 itself.

To insure that the finger members 132 of the pivotally mounted yoke 126 ordinarily engage the actuator rod 118 in straddling relation, the yoke member 126 is provided with a tension spring 134. The spring 134 is connected to the yoke end 130 and to the container frame assembly 22. To release the pivotally mounted yoke 126, a suitably positioned member 136 must engage the lever end 128 of the detent assembly and overcome the bias of the tension spring 134. The member 136 may be part of a container unloading system and allows the finger members 132 to rotate downwardly about the pivot 138 into a non-interfering position as illustrated by the phantom lines of FIG. 8.

Each corner of the container frame assembly 22 has a latch block 140 (see FIG. 7) that includes an elongated recess 142 which is adapted to receive a corresponding configured container lock (not shown). When the container 20 is positioned, for example, on a railroad car, the locks are received vertically by the corresponding recesses 142 of the latch blocks 140. When the container is fully seated on the railroad car to which it is to be secured, the locks are rotated 90° such that the major axis of the lock moves into general alignment with the minor axis of the recess 142.

The second end 150 (see FIG. 1) of the container 20 is open. To provide an enclosed volume for receiving refuse material in the container, the container has a longitudinally slidable refuse restraining assembly that prevents discharge of refuse material from the open end 150. The refuse restraining assembly includes a transverse bulkhead assembly 160 that can slide between the ends of the container 20.

The container walls 24 (see FIG. 9) are each provided on their inner surface with a guide assembly 162. The guide assembly 162 may comprise, for example, a U-shaped channel member 164 which is mounted on the corresponding side wall 24 so that it extends longitudinally along the container cavity. Each channel member 164 is spaced above the horizontal floor 30 and may be provided with beveled support members 166, 168. The beveled support members 166, 168, are connected to the wall 24 and engage the U-shaped channel 164 adjacent the open end thereof such that a longitudional slot is provided along the side wall 24 on the inside of the container 20. The beveled support members 166, 168 help to avoid unnecessary corners in which refuse material may become lodged. The two guide assemblies 162 are symmetrically disposed with respect to the longitudinal centerline of the container 20.

The bulkhead assembly 160 includes a frame assembly 170 (see FIG. 10) having a vertically extending portion 172 and a horizontally extending portion 174. The horizontally extending portion 174 is provided with a pair of flanges 176. Each flange 176 extends toward a corresponding side wall 24 and has a pair of spaced apart shoes 178, 180 on the under side. The shoes 178,180 slide on a horizontal surface of a corresponding channel 164 and guide the bulkhead assembly 160 during longitudinal translation in the container.

Each flange 176 also has a second pair of shoes 179,181 positioned on the upper side thereof in general vertical alignment with the lower shoes 178,180. The upper shoes 179,181 preferably have a small clearance with the upper horizontal surface of the guide member 164. The upper shoes 179,181 provide stability from tipping of the frame assembly 160 about a horizontal axis extending between the side walls 24.

The vertically upstanding frame portion 172 includes a generally vertical bulkhead portion 182 at the upper and thereof which faces the tailgate assembly 34. Below the generally vertical bulkhead portion 182 is an inclined bulkhead portion 184 having its upper edge connected to the lower edge of the vertical bulkhead portion 182. The inclined bulkhead portion 184 is partially supported by the horizontal frame portion 174 and has a lower edge 186. The lower edge 186 is positioned closer to the container tailgate assembly 34 than the upper edge.

The bulkhead assembly 160 also includes a transversely extending beam 188 (FIG. 9) which is part of a vertically displaceable frame assembly. Attached to each end of the beam 188 is an L-shaped angle section 190 which is generally perpendicular to the axis of the beam 188. Each angle section 190 has a projecting finger-like flange 192 which is positioned to be received in the corresponding U-shaped channel 164. Each flange 192 has a pad 194 of suitable friction material on the upper surface thereof.

To prevent the beam 188 from moving laterally with respect to the bulkhead assembly 160, the horizontal frame portio 174 is provided, on each side, with a pair of short vertical guides 196,198 (FIG. 10). The vertical guides 196,198 are spaced apart in the longitudinal direction to accommodate the beam 188 and guide vertical movement thereof.

The friction pads 194 move along with the beam 188 and are positioned between the shoes 179,181. When the beam 188 is raised, the friction pads 194 frictionally contact the upper internal surface of the U-shaped guides 164. At the same time, the lower pads 178,180 frictionally contact the lower internal surface of the guides 164. Accordingly, the pads 194,178,180 cooperate to resist movement of the bulkhead assembly 160 relative to the guides 164 and thus the container 20. With the beam 188 raised, the pads 178,180,194 inhibit movement of the bulkhead assembly 160 in either longitudinal direction in the container.

On the other hand, if the friction pads 194 are not raised vertically into engagement with the corresponding guide channel surfaces, the friction pads 194 do not engage and do not cause the lower pads 178,180 to frictionally inhibit movement of the bulkhead assembly.

Spaced inwardly from each end and on the underside of the transverse beam 188 is a bearing pad 200. Each bearing pad 200 is engaged by a corresponding cam 202 on the end of a corresponding lever cam 204. Each lever cam 204 is pivotally attached to the horizontal frame portion 174 and has a tie rod 206 pivotally connected to its distal end. Each tie rod 206 is connected to and in general alignment with a spring actuated rod 208 that slidably extends from a corresponding end of a circularly cylindrical spring housing 210.

The spring housing 210 (FIG. 10) may be suitably attached to the horizontal frame portion 174 such as by a bracket 212. The spring housing 210 contains a compression spring 214 (FIG. 9) that resiliently urges each actuated rod 208 outwardly from the spring housing 210.

Each end of the spring housing 210 may be provided with one or more suitable adjustment bolts 216 to control the resilient force exerted on the end of the actuator rods 208. It will be seen that the force exerted on the distal end of each lever cam 204 tends to rotate the lever cam 204 causing the cam end 202 to act on the corresponding bearing pad 200. The cam end 202 thus causes the transverse beam 188 to be raised and the friction pads 194 and the lower pads 178, 180 to engage the channels 164. In this manner the bulkhead assembly 160 is frictionally restrained.

During advancement of the bulkhead assembly 160 toward the tailgate assembly 34 to discharge the container contents, it is desirable to release the friction pads 194 from engagement with the guides 164. Accordingly, the distal end of each lever cam 204 is connected to a second tie rod 218. Each tie rod 218 is pivotally connected to the lower end of an actuator rod 220.

The actuator rod 220 is positioned along a vertical plane of symmetry for the bulkhead assembly 160 and is slidably mounted in a guide block 222 (FIG. 9) positioned centrally on the beam 188. The actuator rod 220 is pivotally connected at its upper end to one arm of a bell crank 224 (FIG. 10). A second arm of the bell crank 224 is proximally disposed to a transversely extending push bar 226 carried by the vertical frame portion 172. The bell crank 224 is pivotally mounted to the vertical frame portion 172 with the second arm 225 in a generally vertical posture.

When the bulkhead is to be advanced it must be pushed. Accordingly, a suitable push rod 228 (FIG. 11) is provided with a U-shaped recess 230 which conforms to the external contour of the transversely extending push bar 226. The end of the push rod 228 also engages the second arm 225 of the bell crank 224 when it engages the push bar 226 to forcibly advance the bulkhead assembly 160. Engagement of the bell crank 224 by the push rod 228 rotates the bell crank 224 about its pivot and lifts the actuator rod 220. The actuator rod 220 acts through the tie rods 218 to pull the lever cams 204 inwardly toward the center line against the spring bias of the spring 214. Rotation of the lever cams 204 and the cams 102 permits the transverse beam 188 to lower thereby releasing frictional engagement between the friction pads 194 and the longitudinal guides 164.

When the bulkhead assembly 160 has advanced to the tailgate assembly 34 of the container 20 withdrawal of the push rod 228 releases pressure on the second arm 225 of the bell crank 224 thereby allowing the compression spring 214 to cause engagement of the friction pads 194 with the guides 164.

In operation, the closure door 42 (FIG. 4) in the upper portion of the tailgate assembly 34 is lifted so that an opening is defined in the tailgate assembly 34. The opening may be aligned with a packer assembly. Hooks carried by the packer assembly may rest on bearing strips 232 mounted on the end columns 36 (FIG. 2) so that the packer and container do not separate during loading. The packer assembly pushes refuse into the container interior under pressure.

As the refuse fills the container 20, the inclined lower portion 184 (FIG. 1) of the transverse bulkhead assembly 160 causes the refuse to fill the container vertically. Continued addition of solid waste material to the container 20 through the opened closure door 42 causes an increased pressure to be exerted against the bulkhead assembly 160. When the pressure exceeds the predetermined level, the bulkhead assembly recedes toward the open end 150 by virtue of the sliding which is allowed between the friction pads 194 and the longitudinal guides 164. When the container 20 has been completely filled, the closure door 42 is closed thereby providing a completely enclosed cargo of solid waste refuse material.

When it is desired to empty the container 20, the pivotally mounted yoke 126 (FIG. 8) of the latching assembly is displaced such that the fingers 132 no longer prevent longitudinal movement of the actuator rod 118. The free end 234 of the actuator rod 118 is engaged by suitable actuating mechanism 236 which displaces the rod 118 longitudinally along the center line of the frame assembly 22. In so doing, the second connector members 88 (FIG. 7) are withdrawn from their overlapping latching position with respect to the corresponding first connector elements 80. Accordingly, the tailgate assembly 34 is free and can be moved vertically about a horizontal axis 40 with a swinging motion.

Preferably, a push rod 228 comprising the end of a hydraulic cylinder (FIG. 11) is advanced against the push rod 226 of the bulkhead assembly 160 to engage the second arm 225 thereby releasing the friction pads 194 and beginning advancement of the bulkhead assembly 160 towards the opened tailgate assembly 34. As the bulkhead assembly 160 advances longitudinally from the second end 150 to the first end 32 of the container 20, refuse material in front of the bulkhead assembly 160 is ejected from the opened first end 32 of the container 20.

When the container is operatively connected to the associated compactor it is necessary to provide hooks engaging the end portion of the side walls adjacent to the tailgate assembly. Accordingly, the vertically upstanding end columns adjacent the tailgate assembly are provided with a reinforced surface and the side walls of the container are provided with locally reinforced structure. In this manner the damage to the container through repeated use of hydraulically operated latching assemblies is dimished.

Leakage of liquid refuse from the first end 32 of the container 20 is inhibited by a seal effected between the tailgate assembly 34 and the container side walls 24 and floor 30 when the connecting elements 80,88 are engaged.

It should now be apparent that there has been provided in accordance with the present invention a novel refuse container which substantially accomplishes the objects set forth above as well as others. It will also be apparent that many modifications, variations, substitutions and equivalents of various elements of the refuse container described above may be made without departing from the spirit of the invention. Accordingly, it is expressly intended that all such modifications, variations, substitutions and equivalents falling within the spirit and scope of the invention as defined in the appended claims be embraced thereby.

What is claimed is:

1. A transportable refuse container comprising:
walls defining a tubular body having a pair of ends;
slideable bulkhead means within the body and displaceable between the pair of ends;
end closure means hingedly connected to one end of the body, openable for container unloading, and having an opening for filling the container;
the other end of the body having an opening operable to receive means for advancing the bulkhead means; and
frictional resistance means carried by the bulkhead means, operable to frictionally resist movement of the bulkhead means relative to the container, and releasable during movement of the bulkhead means toward the end closure means so that the force necessary to advance the bulkhead means is minimized.

2. The refuse container of claim 1 wherein frictional force exerted by the frictional resistance means is adjustable so that force acting on the bulkhead means must exceed a predetermined value to move the bulkhead means against the frictional force.

3. The refuse container of claim 1 wherein the frictional resistance means includes friction pads that frictionally engage surfaces of the walls.

4. The refuse container of claim 1 wherein:
the bulkhead means includes a frame means for mounting the frictional resistance means; and
the walls include guide means extending between the ends thereof, the guide means having surfaces engaged by the frictional resistance means and being operable to guide the frame means during movement longitudinally between the ends of the body.

5. A transportable refuse container comprising:
walls defining a tubular body having a pair of ends; slideable bulkhead means within the body and displaceable between the pair of ends;
end closure means hingedly connected to one end of the body, openable for container unloading, and having an opening for filling the container;
the other end of the body having an opening operable to receive means to operate the bulkhead means;
frictional resistance means carried by the bulkhead means, operable to resist movement of the bulkhead means relative to the container, and releasable during movement of the bulkhead means toward the end closure means so that the force necessary to advance the bulkhead means is minimized;
wherein the bulkhead means includes a frame means;
wherein the walls include guide means extending between the ends thereof, the guide means having surfaces engaged by the frictional resistance means and being operable to guide the frame means during movement longitudinally between the ends of the body;
wherein the guide means includes a pair of U-shaped channels, each channel attached to a corresponding wall, having a longitudinal opening facing the container cavity and a pair of vertically spaced apart surfaces;
wherein the frame means includes
spaced apart shoes on each side that are slidably supported on the lower surfaces of the channels, and
a vertically displaceable transverse frame having laterally extending fingers projecting through the longitudinal openings of the channels; and
friction pads are carried on corresponding fingers of the frame means.

6. A transportable refuse container comprising:
walls defining a tubular body having a pair of ends;
slideable bulkhead means within the body and displaceable between the pair of ends;
end closure means hingedly connected to one end of the body, openable for container unloading, and having an opening for filling the container;
the other end of the body having an opening operable to receive means to operate the bulkhead means;
frictional resistance means carried by the bulkhead means, operable to resist movement of the bulkhead means relative to the container, and releasable during movement of the bulkhead means toward the end closure means so that the force necessary to advance the bulkhead means is minimized; and
wherein the bulkhead means includes
a frame structure,
a vertically movable member having a surface and carrying the frictional resistance means,
means constraining the vertically movable member from lateral movement relative to the frame structure,
a lever cam pivotally mounted on the frame structure having a lever end and a cam surface engaging the surface of the vertically movable member,
resilient means acting on the lever end and operable to cause engagement of the cam surface with the surface thereby lifting the vertically movable member, and
linkage means pivotally connected to the lever end, operable to release the resilient means and permit movement of the cam surface thereby lowering the vertically movable member and releasing the frictional resistance means.

7. The refuse container of claim 1 further including a downwardly extending apron attached to the tubular body at the one end, abutted by the end closure means, and substantially free of projections extending toward the end closure means whereby material leaving the container has essentially no tendency to hang-up.

* * * * *